US005248135A

United States Patent [19]

Leu

[11] Patent Number: 5,248,135

[45] Date of Patent: Sep. 28, 1993

[54] METHOD OF, AND APPARATUS FOR, OPENING FLEXIBLE PRODUCTS FOLDED OFF-CENTER

[75] Inventor: Willy Leu, Pfäffikon, Switzerland

[73] Assignee: Ferag AG, Hinwil, Switzerland

[21] Appl. No.: 910,692

[22] Filed: Jul. 8, 1992

[30] Foreign Application Priority Data

Jul. 11, 1991 [CH] Switzerland ..... 02074/91

[51] Int. Cl.[5] ..... B65H 5/30; B65H 29/04

[52] U.S. Cl. ..... 270/55; 271/204

[58] Field of Search ..... 270/54, 55; 271/204

[56] References Cited

U.S. PATENT DOCUMENTS

| | | | |
|---|---|---|---|
| 3,580,562 | 5/1971 | Reist | 270/54 |
| 3,601,388 | 8/1971 | Hilliard | 270/54 |
| 3,650,524 | 3/1972 | Hepp | 270/54 |
| 3,722,877 | 3/1973 | Wetter | 270/54 X |
| 4,381,056 | 4/1983 | Eberle . | |
| 4,398,710 | 8/1983 | Hansch | 270/55 |
| 4,489,930 | 12/1984 | Meier . | |
| 4,555,101 | 11/1985 | Stobb | 271/204 X |
| 4,678,174 | 7/1987 | Reist | 270/54 |
| 4,684,116 | 8/1987 | Hansch . | |
| 4,684,117 | 8/1987 | Honegger et al. . | |
| 4,775,137 | 10/1988 | Glanzmann | 270/54 |
| 5,052,667 | 10/1991 | Hansch . | |
| 5,169,139 | 12/1992 | Stauber et al. | 271/204 |
| 5,188,349 | 2/1993 | Honegger | 271/204 |

FOREIGN PATENT DOCUMENTS

0208081A1 7/1986 European Pat. Off. .

*Primary Examiner*—Edward K. Look
*Assistant Examiner*—John Ryznic
*Attorney, Agent, or Firm*—Willian Brinks Olds Hofer Gilson & Lione

[57] ABSTRACT

Folded printed products, held at the fold thereof by clamps, are fed to an opening device. This opening device comprises grippers, each gripper having a stationary gripper jaw and a movable gripper jaw which delimit a slide gap in the closed position of the movable gripper jaw. Along this slide gap there is displaceable a pusher member for the purpose of pushing out of the slide gap the printed product gripped at its open-edge region by the respective gripper. The pusher member thereby acts upon a marginal lap of a first product portion which protrudes beyond the other or second product portion. By virtue of the pre-bending of the printed products, the second product portion is entrained during pushing action at the first product portion and, as a beneficial result of such bending, lifts off from the first product portion upon leaving the slide gap, the marginal lap of the first product portion still being guided in the slide gap.

28 Claims, 7 Drawing Sheets

METHOD OF, AND APPARATUS FOR, OPENING FLEXIBLE PRODUCTS FOLDED OFF-CENTER

CROSS-REFERENCE TO RELATED PATENT APPLICATION

This application is related to the commonly assigned, U.S. Pat. No. 5,052,667, filed May 9, 1989, entitled "DEVICE FOR THE COLLECTION OF FOLDED PRINTED SHEETS".

BACKGROUND OF THE INVENTION

The present invention broadly relates to collecting flexible folded products and pertains, more specifically, to a new and improved method of opening flexible folded products, which have been folded off-center. The present invention also relates to a new and improved apparatus for carrying out the inventive method.

The off-center or asymmetrically folded product possesses an open-edge region located opposite to the fold and comprises in this open-edge region a marginal lap at a first product portion, the marginal lap protruding beyond the other or second product portion.

Generally speaking, the method of the present invention is of the type according to which the flexible, off-center folded products are held at the off-center fold thereof and, in each case, at least the marginal lap of the off-center folded products is gripped or engaged by gripper jaws of a respective gripper of an opening device, the gripper jaws being movable in relation to each other.

In its more specific aspects, the new and improved apparatus for opening flexible asymmetrically folded products, such as printed products, each product having in an open-edge region, located opposite the off-center fold, a marginal lap at a first product portion, the marginal lap protruding beyond the other or second product portion, comprises holding means for holding or retaining the folded products at the respective off-center folds thereof, an opening device having at least one gripper with gripper jaws movable in relation to one another for gripping or engaging at least the marginal lap of a respective folded product, and bending means serving to bend or flex at least the first product portion engaged by the gripper, in order to at least partially lift off the two product portions from one another.

An example of an apparatus of this type for opening off-center folded printed products is known from European Patent Application No. 0,208,081, published Jan. 14, 1987 and the corresponding U.S. Pat. No. 4,684,117, granted Aug. 4, 1987 and assigned to the assignee of the instant application. In this prior art apparatus, the folded printed products to be opened are conveyed with the respective folded edges held by individually controllable grippers or clamps of a feeder. The direction of conveyance extends downwardly and inclinedly and the mouth or open jaw of the grippers is forwardly directed in the direction of conveyance, so that the open-edge region of the printed products conveyed in a downwardly and obliquely directed position or state is leading with respect to the folded edge located opposite the open-edge region. Below the feeder there is provided an opening device comprising holding clamps attached at uniform distances to a revolvingly driven traction element, these distances being smaller or shorter than the regular spacings between the grippers or clamps of the feeder. The traction element is guided at both ends over sprocket wheels, so that the active run extends approximately parallel to the direction of conveyance of the feeder. Each holding clamp comprises a stationary clamp support and a movable resilient clamping finger which is pre-stressed and, as seen in the direction of conveyance, is directed to the rear. In the region of the active run and of the sprocket wheel at the end of the opening device there is provided a support plate or panel for the leading edges of the printed products. In an embodiment with two chains arranged parallel to one another and provided with holding clamps attached to these chains, the holding clamps extend through longitudinal slots in the support plate, whereby the stationary clamp supports passing through these longitudinal slots are substantially in alignment with the support plate. Furthermore, co-rotating with the upstream sprocket wheel and connected thereto is a guide wheel. A round endless belt with an upper run upstream of the support plate is trained about this guide wheel. The printed products supplied by the feeder arrive with their respective open edges resting on the upper run of the round endless belt and are thereby brought into the correct position to be later retained by the holding clamps.

In the region of the linear or straight active run of the opening device, the movable resilient clamping fingers are raised or elevated from the stationary clamp supports by means of a guide cam and retained in an upper product-releasing position, so that—due to the lower circumferential speed of the holding grippers with respect to the conveying speed of the printed products—the leading marginal lap of the lower longer product portion protruding beyond the upper shorter product portion can move into the open holding clamp. In the transfer zone from the straight active run to the downstream sprocket wheel, the respective holding clamp moves out of the effective region of the guide cam, so that the movable resilient clamping finger moves downwardly as a result of its resilient elasticity into a clamping position and thereby holds the leading marginal lap. The holding clamp enters the guide region of the curved section of the support plate defined by the downstream sprocket wheel. The clamped leading marginal lap and, accordingly, the lower longer product portion is guidedly bent along the curved section of the support plate such that the shorter not retained product portion is urged to move away from the retained lower product portion and is thereby separated therefrom. A saddle-shaped support of a revolvingly driven collecting device moves into the opening formed by the two product portions which, subsequent to opening the related holding clamp, surround from above the respective saddle-shaped support. By opening the associated gripper or clamp of the feeder, the released printed product falls in a straddling manner onto the respective saddle-shaped support.

However, when the longer product portion possessing the leading marginal lap is on the upper side of the infed folded product, the feeder and the opening device have to be mutually synchronized such that the movable resilient clamping finger, upon being raised or elevated, lifts the marginal lap from below. As a result of the relative speed between the traction element of the opening device and the feeder, the open-edge region of the underlying shorter product portion comes into contact with the open movable resilient clamping finger or with respective stop elements or dogs. The clamping finger then moves into its clamping position and retains the shorter product portion which is moved as previously described along the curved section of the support plate. The longer product portion comprising the marginal lap thereby separates itself, by virtue of its inherent stiffness, from the bent shorter product portion retained at the curved support plate.

This known prior-art apparatus for opening printed products folded off-center or asymmetrically requires accurate synchronization between the feeder and the holding clamps of the opening device. In order to ensure under all conditions a reliable opening of all printed products, it is essential that the printed products to be opened meet exacting dimensional tolerances and assume a precisely defined position in the mouth of the respective holding clamps. This requires a corresponding constructional and manufacturing expenditure as well as considerable time-consuming adjustment work and extensive preparatory operations, especially in the case of change-over from one product size to another.

A prior art apparatus for collecting folded printed sheets and provided with a device for opening the non-centrally folded printed sheets conveyed while being retained or held at the fold thereof by grippers of an infeed device is known, for example, from European Patent Application No. 0,095,603, published Dec. 7, 1983 and the corresponding U.S. Pat. No. 4,489,930, granted Dec. 25, 1984 and assigned to the assignee of the instant application. Each gripper of the infeed device possesses a gripper mouth or jaw extending rearwardly with respect to the conveying direction of the collecting conveyor. Below the infeed device there is arranged the opening device which also comprises a revolving gripper belt at which holding clamps are spaced at essentially equal distances from one another like the grippers of the infeed device. These holding clamps of the gripper belt of the opening device serve in each case to hold the marginal lap of the upper longer printed-sheet portion overlapping the underlying shorter printed-sheet portion, while this shorter printed-sheet portion is moved away from the retained longer printed-sheet portion by means of a revolvingly driven small conveyor belt which follows the revolving gripper belt and travels at a considerably higher speed than the conveying speed of the infeed device. The trailing edge of the free shorter printed-sheet portion thereby drops to one side of an arriving receiving saddle. Thereafter, the holding clamp at the end of the gripper belt releases the trailing edge or marginal lap of the longer printed-sheet portion to drop to the other side of the receiving saddle which has been further displaced in the meantime. Finally, the associated gripper of the infeed device releases the printed sheet so that the same is positioned in a straddling fashion upon the corresponding receiving saddle under the action of its own weight. This known opening device of the prior-art apparatus for collecting off-center folded printed sheets is afflicted with essentially the same drawbacks and disadvantages as the aforedescribed prior-art construction disclosed in European Patent Application No. 0,208,081 and the corresponding U.S. Pat. No. 4,684,117.

An apparatus for opening printed products that have been inserted in radial direction into pocket-shaped compartments of a drum-type cell wheel is known, for example, from Swiss Patent No. 644,814, published Aug. 31, 1984 and the corresponding U.S. Pat. No. 4,398,710, granted Aug. 16, 1983 and assigned to the assignee of the instant application. Each printed product bears with the fold thereof upon the base portion of an outwardly open holder of a carriage at the rear end of each compartment partition wall and is held there by gripper jaws which press the printed product against a flange of the outwardly open holder. The inserted off-center folded printed product bears upon a support surface of a compartment partition wall by means of its longer product portion which possesses the marginal lap and thereby protrudes beyond the shorter product portion. To open the inserted off-center folded printed products, each compartment partition wall comprises at its outer edge two bending spring elements which cooperate with control cam surfaces of stationary cams and protrude by means of their free ends into the interior of the respective compartment. During rotation of the cell wheel, one bending spring element forming a pre-separation element and possessing an entrainment dog travels upon a control cam surface and is moved towards the open edge of the printed product, whereby the entrainment dog engages the marginal lap and entrains the lower longer product portion during its further forward movement. This results in a bowing-out or doming of the lower longer product portion. Accordingly, the upper shorter product portion is raised and a gap is formed between the two product portions which are to be separated from one another. The other bending spring element forming a holder element now travels upon the other control cam surface and its free end advances radially into the compartment and is thereby gradually lifted or elevated. This holder element enters the gap and engages below the raised upper product portion. During further rotation of the cell wheel the first bending spring element or pre-separation element with the entrainment dog is retracted from the compartment. The bowing-out of the lower product portion thus disappears, but the printed product is maintained open by the second bending spring element or holder element. In this known opening device located at the compartment partition wall of a cell wheel, it is necessary that the printed product bears upon a support surface and is not moved or displaced as long as the entrainment dog acts upon or engages the marginal lap of the lower or underlying longer product portion.

SUMMARY OF THE INVENTION

Therefore, with the foregoing in mind, it is a primary object of the present invention to provide a new and improved method of, and apparatus for, opening flexible products folded off-center, such as printed products, and which are not afflicted with the drawbacks and limitations of the prior art.

Another and more specific object of the present invention aims at providing a new and improved method of, and apparatus for, opening flexible off-center folded products and which in a simple manner permit reliable opening of products folded off-center, without these products having to assume a precisely defined position.

Yet a further significant object of the present invention aims at providing a new and improved construction of an apparatus of the character described which permits using simple means requiring a minimum of space, is relatively economical to manufacture and yet affords highly reliable operation thereof.

Now in order to implement these and still further objects of the present invention, which will become more readily apparent as the description proceeds, the method of the present development is manifested, among other things, by the steps of gripping in each case both product portions in the region of the open edge by means of the gripper, conjointly pre-bending in each case both product portions, forming in the closed state of the gripper jaws a slide gap for the respective product portions, and moving the open-edge region towards the off-center fold, so that during further movement by pushing the marginal lap towards the related off-center fold at least the second product portion is ejected from the slide gap, whereby the second product portion is moved apart or separated from the first product portion as a result of the bending or bowing-out of the first product portion.

When the gripper jaws are actuated to assume a closed state, the position of the folded product relative to the respective gripper is not at all relevant for the subsequent opening of the folded product, since the relevant position of the two product portions for opening the folded product is determined by the pushing at the marginal lap of the first product portion protruding beyond the second product portion. By mutually pre-bending the engaged product portions in such a manner that the first product portion is inlying, the second product portion is inevitably entrained when the marginal lap of the first product portion is pushed, so that the marginal lap is still guided in the slide gap when the second product portion has already left the latter. The bending or bowing-out of the folded product is further augmented by pushing the open-edge region in the direction towards the related off-center fold, with the beneficial result that the separation of the second product portion from the first product portion is substantially improved.

Subsequent to the ejection of the second product portion from the slide gap formed between the gripper jaws, the marginal lap of the first product portion is pushed out of the slide gap.

The marginal lap is advantageously pushed by means of a pusher member acting at the edge of the marginal lap and, subsequent to leading the slide gap, is clamped between the pusher member and a preferably bead-shaped nose of the respective gripper.

The clamping of the marginal lap after ejection thereof from the slide gap permits pushing at high speed and ensures reliable opening also of off-center folded products having a relatively narrow protruding marginal lap.

This clamping operation entails bending the first product portion away from the second product portion.

The direction of the clamping nip or gap formed by the pusher member and the bead-shaped nose cooperating with the latter is selected such that the bowing-out of the first product portion retained in the clamping nip is augmented, thus further improving the lift-off or rise of the second product portion.

Each off-center folded product engaged by a gripper is pre-bent or pre-curved by pivoting the respective slide gap about an axis extending substantially parallel to the product fold and is further bent or curved by being ejected from the slide gap.

The off-center folded products opened by the opening device are maintained open by inserting in each case a keep-open member between the two product portions separated from each other.

The products folded off-center are preferably conveyed in a suspension position or state and retained by respective clamps of a conveyor device at their off-center fold which in each case extends substantially transversely to the direction of conveyance. The folded products are then opened by means of the opening device and the opened folded products are deposited in a straddling fashion upon receiving saddles or saddle-shaped supports of a collecting device.

As alluded to above, the invention is not only concerned with the aforementioned method aspects, but also relates to a new and improved apparatus or installation for performing the inventive method of opening flexible products folded off-center.

In order to implement the aforementioned objects of the present invention, which will become more readily apparent as the description proceeds, the apparatus of the present invention is manifested, among other things, by the features that the gripper jaws of the at least one gripper meant for gripping or engaging both product portions in the open-edge region thereof constitute in their closed position or state a slide gap for both product portions and that the bending means are structured for the purpose of conjointly pre-bending both product portions gripped or engaged by the gripper. The slide gap possesses an open end facing the holding means and thereby extends in a predetermined direction. The at least one gripper is provided with a pusher member which is movable in the predetermined direction of the slide gap and can be brought to act upon the first product portion at the marginal lap thereof, in order to push the open-edge region of both product portions towards the aforesaid open end of the slide gap until at least the second product portion leaves the slide gap.

The position of the folded product in the closed gripper is of no relevance for the opening operation, since the relevant position of the two product portions for the opening operation is determined by the pushing action at the marginal lap. By virtue of mutually pre-bending the product portions such that the first product portion is inlying, the second product portion is forcibly entrained during pushing action at the marginal lap, so that the marginal lap is still guided in the slide gap when the second product portion has already left the latter. The bowing-out of the respective folded product is further augmented by the pushing action and, accordingly, the moving apart of the second product portion from the first product portion is improved.

The slide gap is approximately of the same length as or longer than the open-edge region of the respective folded product to be engaged, and the gripper jaws in the closed state thereof extend substantially parallel to one another.

The gripper jaw which comes to bear upon the first product portion protrudes beyond the free end of the other gripper jaw and provides thereby a free protruding region. The gripper jaw comprises in this free protruding region a protuberant structure, preferably a bead-like nose, which laps over the slide gap at a distance. This protuberant structure leads to a very pronounced bending or doming of the first product portion in the region of the gripper, so that upon leaving the slide gap the second product portion instantaneously disengages itself from the first product portion.

The pusher member is displaceably mounted at one of the gripper jaws and drive means are provided for moving or displacing the pusher member from a rest position, which is located at the inner end of the slide gap, in the direction towards an ejection position, which is located at the aforesaid open end of the slide gap, and for returning the pusher member from the ejection position to the rest position.

The pusher member in the ejection position forms with the aforesaid protuberant structure a clamping nip or gap for the marginal lap of the first product portion.

Retaining the marginal lap in the clamping nip permits pushing at high speed and ensures reliable opening also of off-center folded products having a relatively narrow protruding marginal lap.

The clamping nip or gap defines with the slide gap an obtuse angle. In this manner, the bowing-out of the first product portion retained in the clamping nip is augmented, thus further improving lift-off of the second product portion.

The at least one gripper comprises a base or carrier body, at which one gripper jaw, preferably the gripper jaw which is intended for bearing upon the first product portion, is stationarily arranged and the other gripper jaw is pivotably mounted. Furthermore, the pusher member is displaceably mounted preferably at the stationarily arranged gripper jaw. It will also be conceivable that the other gripper jaw constituting the movable gripper jaw can be displaceably mounted at the base or carrier body.

The at least one gripper or, as the case may be, the base or carrier body is pivotably mounted for the purpose of pre-bending the off-center folded products.

The aforesaid holding means comprise a conveyor device having a predetermined direction of conveyance. This conveyor device is provided with individually controllable clamps which are revolvingly driven in the predetermined direction of conveyance and successively arranged in a mutual spaced relationship, these clamps serving to retain and convey the folded products preferably in a suspension position or state and with the off-center fold thereof extending transversely with respect to the predetermined direction of conveyance. The aforesaid opening device comprises at least two guide or deflection wheels and a revolvingly driven traction element which is trained about the at least two guide wheels. The at least one gripper constitutes a plurality of grippers arranged at the traction element and spaced essentially at the same distance as the clamps of the conveyor device, whereby each gripper is operable to act upon a respective off-center folded product to be opened.

Each base or carrier body of a gripper is pivotably mounted at the revolvingly driven traction element and a guide link is provided for each base body. This guide link pivotably acts with one end thereof at the base body and is connected at the other end thereof with the traction element, in order that each gripper upon being trained off of the guide wheel arranged at the start of the opening device, as viewed in the predetermined direction of conveyance, is pivoted in such a manner that the slide gap stands transversely relative to an imaginary plane, taken through the gripper and the respective clamp, for the purpose of pre-bending the respective folded product which is to be opened.

The movable gripper jaw is operable between an open position and a closed position and is pre-biased in the closing direction. A preferably cam-like structured control member for opening the movable gripper jaws is provided in the region of the aforesaid guide wheel arranged at the start of the opening device. Furthermore, the aforesaid drive means for moving the pusher member comprise in the region of the opening-active run of the opening device a preferably likewise cam-like structured control element for the pusher member.

As viewed in the predetermined direction of conveyance, a product processing station is arranged downstream of the opening device. This processing station comprises a plurality of revolvingly driven saddle-shaped supports which serve to receive the opened folded products in a straddling fashion and are preferably arranged in the manner of a drum or cell.

As viewed in the predetermined direction of conveyance, a maintaining-open device is arranged downstream of the opening device. This maintaining-open device comprises a plurality of keep-open members which can be inserted between the product portions moved apart from one another and are co-movable approximately in the direction of conveyance.

The maintaining-open device further comprises a freely rotatable shaft provided with bars arranged in spoke-like manner thereat. Each bar is supported at one end thereof at the shaft and serves for mounting an associated keep-open member at the other end thereof. Respective pivot axles are provided for the bars, these pivot axles extending in the tangential direction relative to the shaft. The bars are rotatably mounted at respective pivot axles and pivotable by means of a control device in such a manner that the keep-open members engage and disengage respective opened folded products. The keep-open members are preferably shaped to be substantially triangular.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters and numerals to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for opening off-center folded printed products has been illustrated therein as is needed to enable one skilled in the art to readily understand the underlying principles and concepts of this invention.

Figure 1:
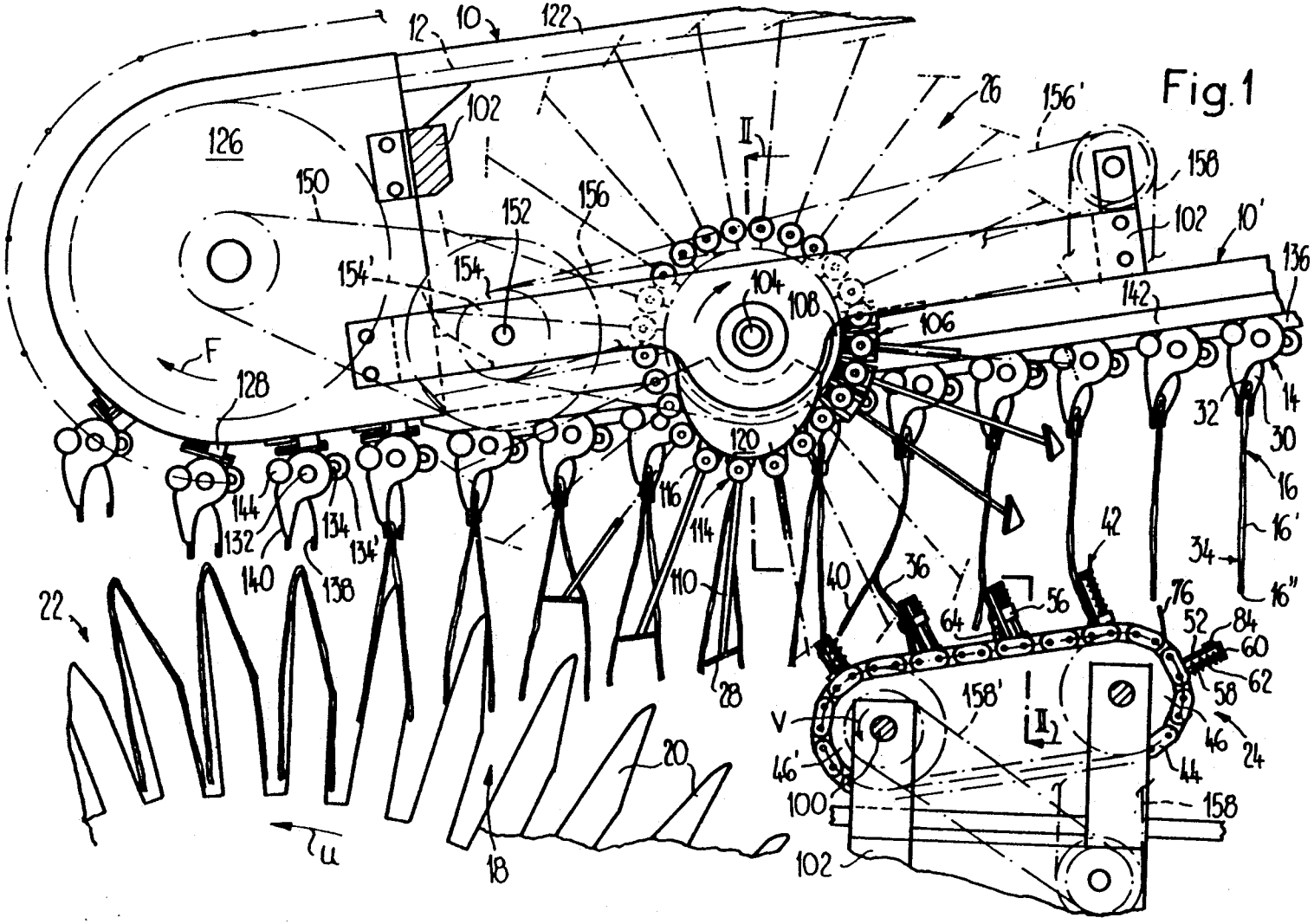
FIG. 1 schematically shows in a side view an apparatus constructed according to the invention and provided with a conveyor device for printed products and an opening device arranged thereunder for opening the folded printed products.
Figure 2:
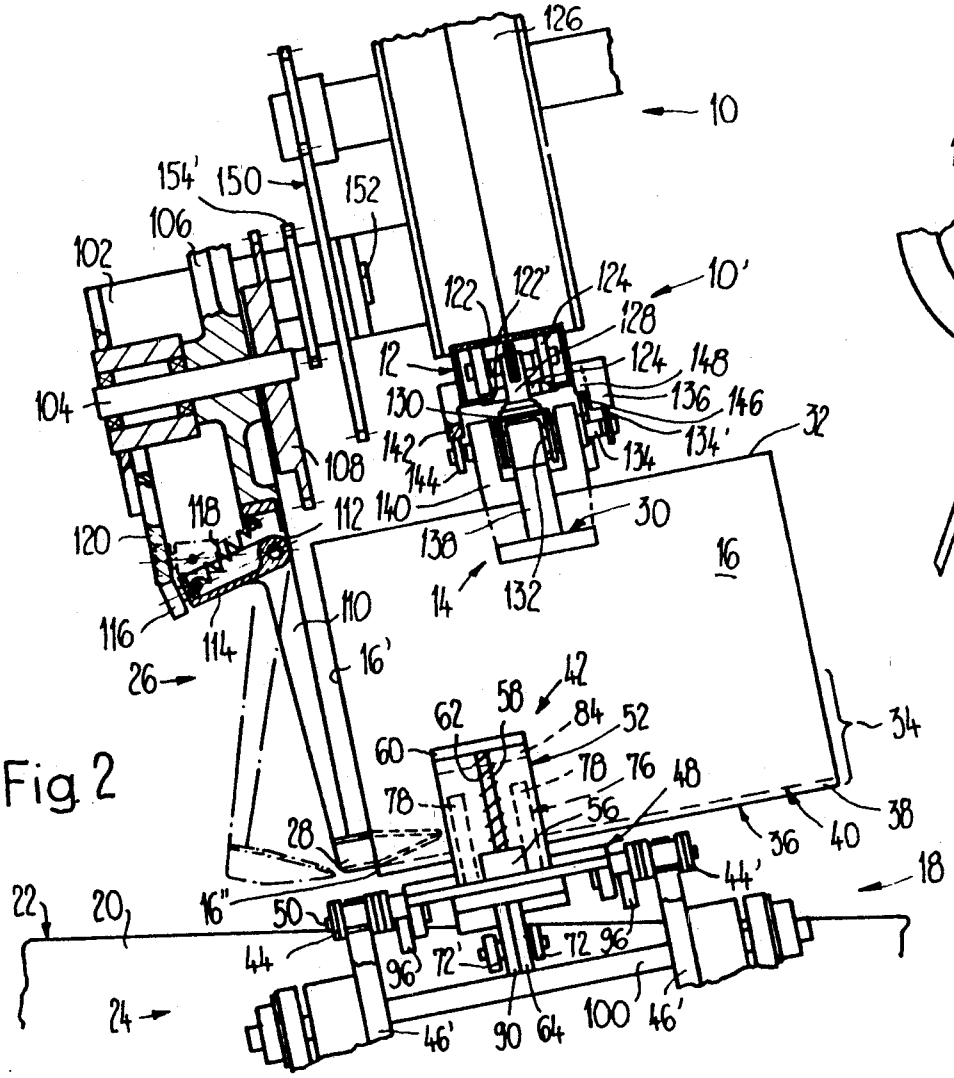
FIG. 2 is a schematic sectional view of a part of the apparatus constructed in accordance with the present invention, taken substantially along the line II—II in FIG. 1.

Turning attention now specifically to FIGS. 1 and 2 of the drawings the installation for conveying, opening and collecting folded printed products and illustrated therein by way of example and not limitation will be seen to comprise a generally known conveyor device 10 provided with individually controllable clamps or grippers 14 spaced at essentially equal distances from one another and successively arranged at an endless traction element 12 revolvingly driven in a predetermined direction of conveyance F. Folded printed products 16, such as newspapers, magazines and the like, are conveyed by means of the conveyor device 10 to a transfer or delivery region 18, where the previously opened printed products 16 are deposited in a straddling fashion upon saddle-shaped supports 20 of a collecting device 22. This schematically illustrated drum-shaped collecting device 22 provided with the supports 20, which are revolvingly driven in a predetermined direction of revolving motion U about a not particularly shown rotational shaft or axle, constitutes the subject matter of European Patent Application No. 0,341,425, published Nov. 15, 1989 and the aforementioned corresponding copending U.S. patent application Ser. No. 07/349,303, to which reference may be readily had and the disclosure of which is incorporated herein by reference. For that reason it is thought unnecessary to provide a more structural representation of the collecting device 22 or any detailed description or discussion of the construction of such collecting drum, apart from general comments made hereinafter for the purpose of placing the subject matter of the present invention in its proper perspective.

As viewed in the predetermined direction of conveyance F, an opening device 24 is arranged upstream of the transfer or delivery region 18. The folded printed products 16 conveyed in a hanging or suspended position are at least partially opened by means of the opening device 24. During the course of conveyance or transport of the printed products 16 from the opening device 24 to the transfer or delivery region 18, the printed products 16 are prevented from closing by means of a maintaining-open device 26 and completely opened along respective lateral edges 16' thereof, into which in each case a keep-open member 28 of the maintaining-open device 26 engages.

In the region of the conveyor device 10 depicted in the partially-cutaway side view in FIG. 1, the lower conveying-active run 10' thereof extends rectilinearly and at right angles relative to the lengthwise extension of the saddle-shaped supports 20 which extend substantially in the horizontal direction. However, as particularly well seen by referring to FIG. 2, the conveyor device 10, the opening device 24 and the maintaining-open device 26 are inclinedly arranged with respect to a vertical plane, so that the folded printed products 16 are conveyed with downwards hanging corners 16''. This slanted or cocked position has the advantage that the printed products 16 only have to be one-sidedly opened in the region of this corner 16'' and kept open at the respective lateral edge 16' adjacent thereto, the complete opening being then accomplished by the movement of the saddle-shaped supports 20 from below into the respective opened regions at the corners 16''.

A mouth or opening 30 of the individually controllable clamps or grippers 14 is directed downwards in the depicted region of the lower conveying-active run 10' and fixedly retains the respective suspendedly conveyed printed product 16 at a fold or spine 32 thereof. The flexible printed products 16 are folded off-center or asymmetrically, so that in a lower open-edge region 34 located opposite the related fold 32, a first product portion 36 possesses a marginal lap 38 which protrudes beyond a second product portion 40. As particularly well seen by referring to FIG. 2 and as viewed in the predetermined direction of conveyance F, the longer first product portion 36 is trailing with respect to the shorter second product portion 40.

Figure 3:
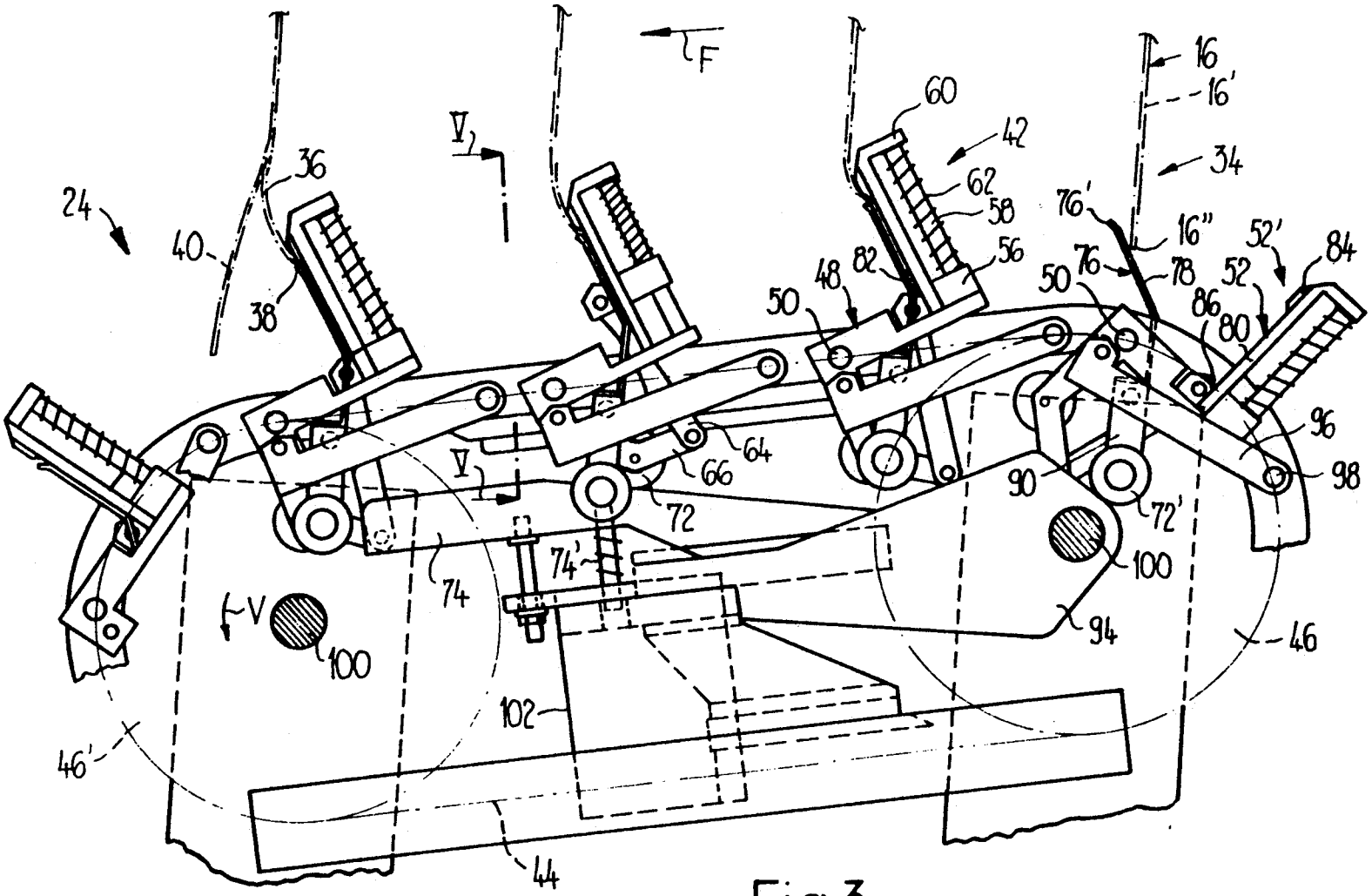
FIG. 3 schematically illustrates in side view and on an enlarged scale in relation to FIG. 1 the opening device.
Figure 4:
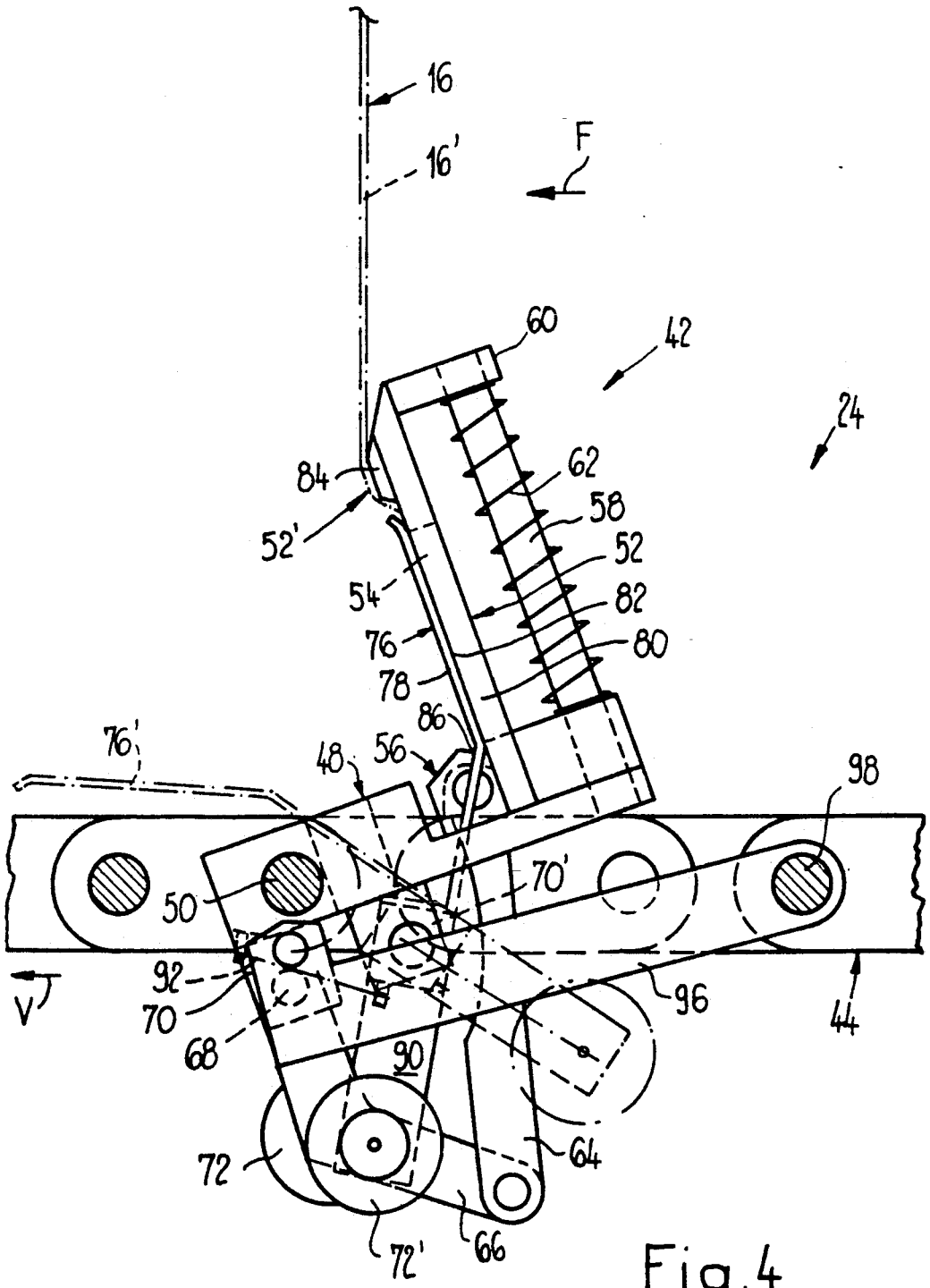
FIG. 4 schematically illustrates in side view an individual gripper of the opening device.
Figure 5:
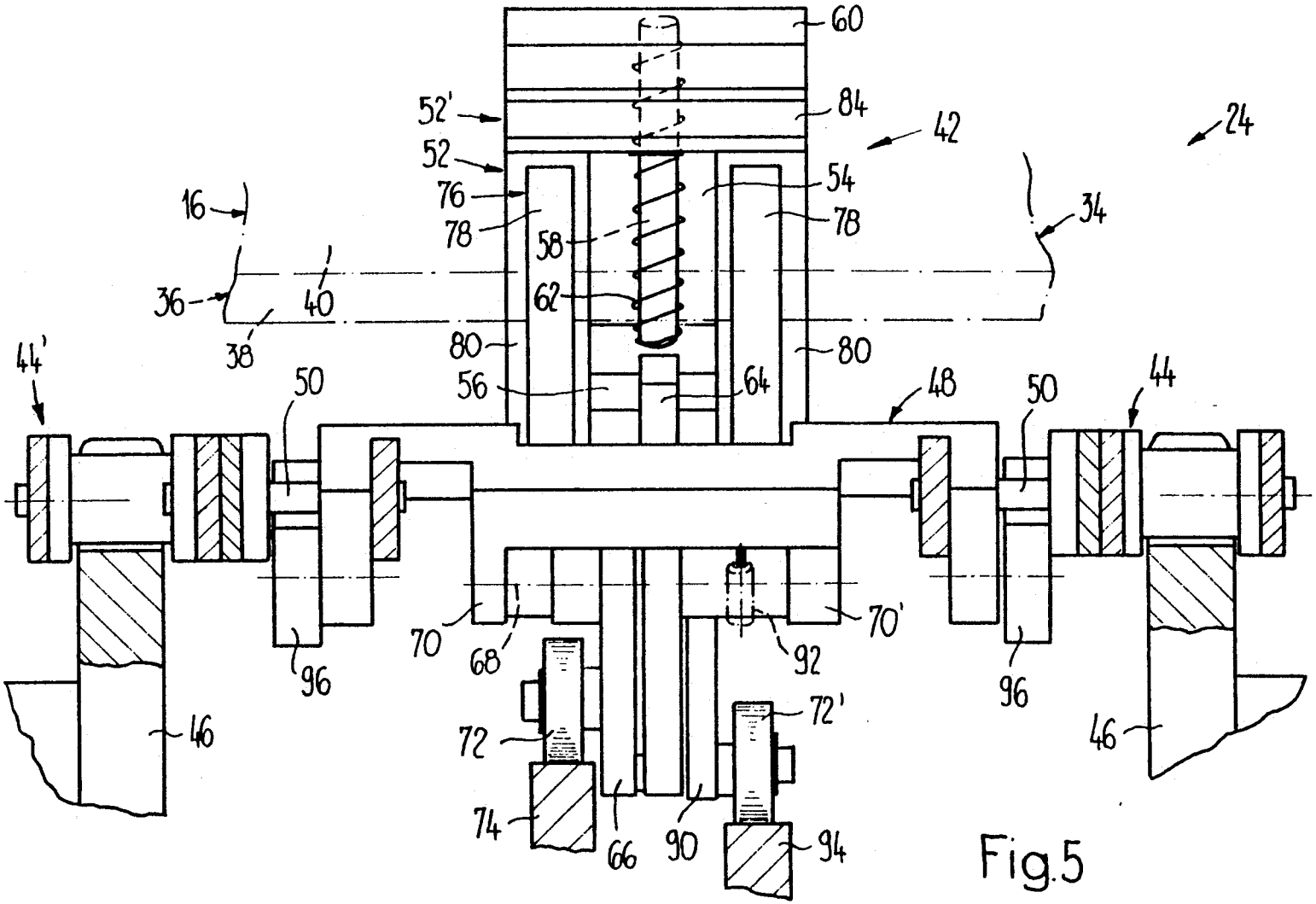
FIG. 5 is a schematic sectional view taken substantially along the line V—V of FIG. 3 and depicting in an enlarged showing a part of the opening device.

Based upon the illustration of FIGS. 3, 4 and 5 there will be now explained in detail the construction of the opening device 24. The opening device 24 comprises a plurality of grippers or gripper units 42 which are spaced at essentially equal distances from one another, these distances corresponding approximately with the equal spacings between the clamps or grippers 14 of the conveyor device 10, and arranged at two endless revolving chains 44 and 44' which are mutually separated by a predetermined spacing and are substantially parallel to one another. These endless revolving chains 44 and 44' are trained about guide or sprocket wheels 46 and 46', so that a not particularly referenced upper run of these chains 44 and 44' extends substantially parallel to the predetermined direction of conveyance F. Furthermore, these endless chains 44 and 44' are driven in a predetermined direction of revolving motion V such that within the region of the aforesaid upper run the grippers or gripper units 42 travel approximately synchronously with and in the same direction as the individually controllable clamps or grippers 14.

Each of the grippers or gripper units 42 comprises a plate-like, stepped base body 48 which in its leading end region, as viewed in the predetermined direction of revolving motion V, is connected on both sides thereof with the endless chains 44 and 44' by means of pivot shafts 50. In the trailing end region of the base body 48 when looking in the direction of revolving motion V, there stands out at right angles from the base body 48 a stationary or non-mobile gripper jaw 52 which, as viewed relative to the chains 44 and 44', projects outwardly. This stationary gripper jaw 52 is recessed to form a cut-out extending from the base body 48 up to a free end region 52' of the stationary gripper jaw 52. This recess or cut-out designated by reference numeral 54 (cf. FIGS. 4 and 5) is structured to permit a cam-like pusher member 56 to pass through. This pusher member 56 is displaceably guided at a guide shaft or rod 58 extending substantially parallel to the non-mobile gripper jaw 52. This guide shaft or rod 58 is secured at its inner or lower end to the base body 48 and mounted with its outer or upper end at a flange 60 of the stationary gripper jaw 52. Between the pusher member 56 and the flange 60 there is provided a compression or pressure spring 62 which surrounds or encloses the guide shaft or rod 58 and presses the pusher member 56 in the direction towards a rest or inoperative position, in which the pusher member 56 rests against the base body 48.

The pusher member 56 is in a region thereof, which juts out from or protrudes beyond the stationary gripper jaw 52 on the side remote from the guide shaft or rod 58, pivotably arranged at a link or bracket 64 which piercingly extends through the base body 48 and, at its other or lower end, is pivotably connected to a curved lever 66. This curved lever 66 is supported at the other end thereof at the base body 48 by means of a pivot shaft or shank 68. For this purpose the base body 48 comprises in its front end region, as viewed in the product direction of conveyance F, a bearing flange 70 which projects downwardly on the other side with respect to the outwardly projecting stationary gripper jaw 52, the pivot shaft or shank 68 being journalled in this bearing flange 70. Approximately in the middle of the curved lever 66, i.e. at the location of the bend or curvature thereof, there is freely rotatably mounted thereat a guide or control roll or follower 72 which cooperates with a cam-type control element 74 (FIG. 3) for the purpose of displacing or shifting the pusher member 56 from its rest or inoperative position depicted in FIG. 4 along the non-mobile gripper jaw 52 in the direction towards the free end region 52' of the latter and into an ejection position 56' depicted in FIG. 9. When the guide or control roll 72 moves off of its cam-type control element 74, the compression or pressure spring 62 presses the pusher member 56 back into the rest or inoperative position thereof, whereby the link or bracket 64 and the curved lever 66 are returned to their position depicted in FIG. 4.

A twin-finger movable gripper jaw 76 cooperates with the stationary gripper jaw 52, whereby in the closed position of this movable gripper jaw 76 two fingers 78 rest against respective webs or walls 80 of the stationary gripper jaw 52, these webs or walls 80 being separated from each other by the recess or cut-out 54. In the closed position of the movable gripper jaw 76, the fingers 78 and the webs 80 delimit two slide or slip gaps 82 for the lower open-edge region 34 of the respective folded printed product 16, these two slide gaps 82 being located in a mutual plane and open at the end remote from the base body 48.

The stationary gripper jaw 52 protrudes with its free end region 52', as viewed in the lengthwise direction of the slide gaps 82, beyond the twin-finger movable gripper jaw 76 located in the closed position thereof. In this free end region 52' there is mounted at the stationary gripper jaw 52 a bead-like nose 84 which extends over the entire width of the stationary gripper jaw 52 and protrudes at a distance beyond the open end of the slide gaps 82.

In the mutual plane of the slide gaps 82 there is recessed in the pusher member 56 a groove 86 which is V-shaped or triangular in cross-section. During ejection of the respective printed product 16 from the slide gaps 82, the groove 86 cooperates with the free end, i.e. with the edge of the marginal lap 38, of the first product portion 36. In the ejection position 56' of the pusher member 56, the groove 86 forms with the bead-like nose 84 a clamping nip or gap 88 for the marginal lap 38 (cf. FIG. 9). This clamping nip or gap 88 and the slide gaps 82 define an obtuse angle.

In the slide gaps 82, the first product portion 36 comprising the marginal lap 38 comes to rest at the stationary gripper jaw 52, whereas the twin-finger movable gripper jaw 76 bears against the second product portion 40. The printed product 16 gripped or engaged by the respective gripper or gripper unit 42 is bent by the bead-like nose 84 in an S-shaped manner between the open ends of the slide gaps 82 and the nose 84. There is thereby achieved the beneficial result that during the ejection process the separation or lifting of the second product portion 40 from the first product portion 36 is substantially improved.

The movable gripper jaw 76, which in the present embodiment is fabricated, for instance, from a suitable sheet-metal material, is mounted at an actuating or operating arm 90 which is pivotably journalled at a further bearing flange of the base body 48, this bearing flange being conveniently designated by reference numeral 70' (cf. FIG. 5). Furthermore, this actuating or operating arm 90 supports at its free end a guide or control roll or follower 72' mounted to be freely rotatable. The movable gripper jaw 76 in the closed position thereof is pre-biased by means of a tension spring 92 acting at one end thereof at the base body 48 and at the other end thereof upon the actuating or operating arm 90. The clamping action exerted by the two gripper jaws 52 and 76 upon the lower open-edge region 34 of the respective printed product 16 is rated such that the latter cannot slip out of the slide gaps 82 by itself, but that the ejection or discharge from the slide gaps 82 is possible without damage to the respective printed product 16. The guide or control roll 72' cooperates with a cam-like control member 94 in order to pivot the movable gripper jaw 76—in the region of the two guide or sprocket wheels 46 arranged, as viewed in the product direction of conveyance F, at the start of the opening device 24—against the force of the tension spring 92 into an open position conveniently designated by reference numeral 76'. The leading movable gripper jaw 76 pivoted into this open position 76' thereof is illustrated together with the actuating or operating arm 90 and the guide or control roll 72' in dot-dash lines in FIG. 4. For reasons of clarity in illustration, the actuating or operating arm and the guide or control roll indicated in dot-dash lines are not particularly referenced in FIG. 4.

The length of the slide gaps 82 delimited by the stationary gripper jaw 52 and the movable gripper jaw 76, as measured from the groove 86 of the pusher member 56 located in the rest position thereof up to the respective open ends of the slide gaps 82, i.e. approximately up to the free end of the movable gripper jaw 76, is substantially greater than the width of the marginal lap 38 of the first product portion 36 protruding beyond the second product portion 40, as is clearly evident by referring to FIG. 2 and FIGS. 6 through 9. By virtue of this measure, the printed products 16 are positively and reliably gripped or engaged by the grippers or gripper units 42 upon closing the respective movable gripper jaws 76 even then, when not all printed products 16 to be processed are precisely of the same size or when not all printed products 16 assume the very same position within the respective clamps or grippers 14.

In order to define the pivotable or swivel position of the grippers or gripper units 42 relative to the endless chains 44 and 44', there are provided two guide rods or links 96 for each gripper or gripper unit 42, these guide rods or links 96 each having a squared-off end portion. The squared-off end portions act eccentrically relative to the pivot shafts 50 at the base body 48, while the other ends of the guide rods or links 96 are pivotably supported at respective chain studs or link pins 98 of the endless chains 44 and 44', respectively, whereby these chain studs or link pins 98, as viewed in the predetermined direction of conveyance F, are trailing with respect to the pivot shafts 50. The guide rods or links 96 ensure that, in the region of the two guide or sprocket wheels 46 and in the region of the two guide or sprocket wheels 46', the stationary gripper jaws 52 extend approximately radially relative to the respective rotational shafts or axles 100 of the guide or sprocket wheels 46 and 46' and, in the region of the upper rectilinear run facing the conveyor device 10 and located between the guide or sprocket wheels 46 and the guide or sprocket wheels 46', the stationary gripper jaws 52 are forwardly inclined or tilted in the predetermined direction of conveyance F and in the predetermined direction of revolving motion V. The pivoting or swinging motion of the grippers or gripper units 42 about the pivot shafts 50 in the pass-over region from the two guide or sprocket wheels 46 to the rectilinear upper run leads to the beneficial result that the folded printed products 16 fixedly retained by the clamps or grippers 14 and gripped or engaged by the gripper jaws 52 and 76 are pre-bent or pre-curved in such a manner that in each case the first product portion 36 with the marginal lap 38, when looking in the radial direction relative to the bend or curvature, extends internally of the bulge.

Figure 6:
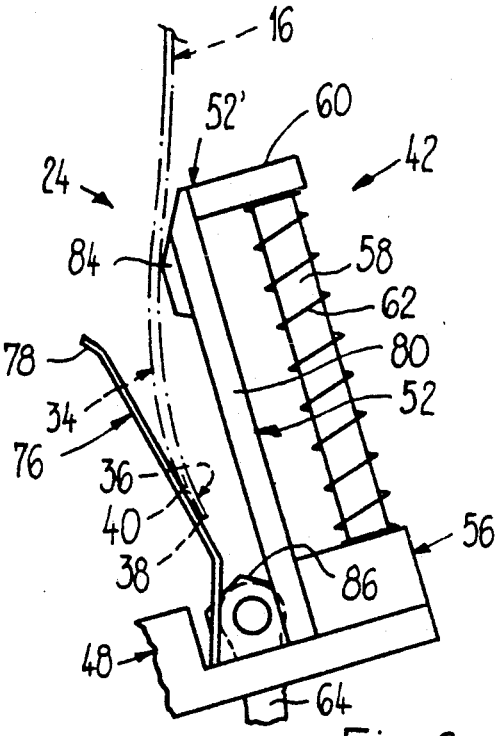
FIG. 6 schematically shows a gripper of the opening device at a first moment of time during the product opening operation.
Figure 7:
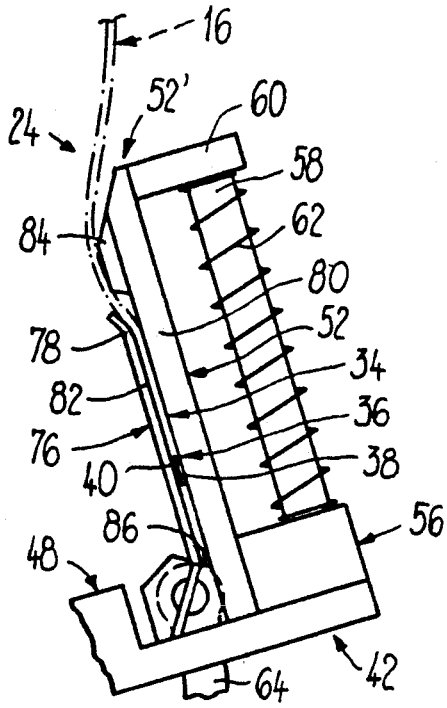
FIG. 7 schematically shows the gripper of the opening device at a second moment of time during the product opening operation.
Figure 8:
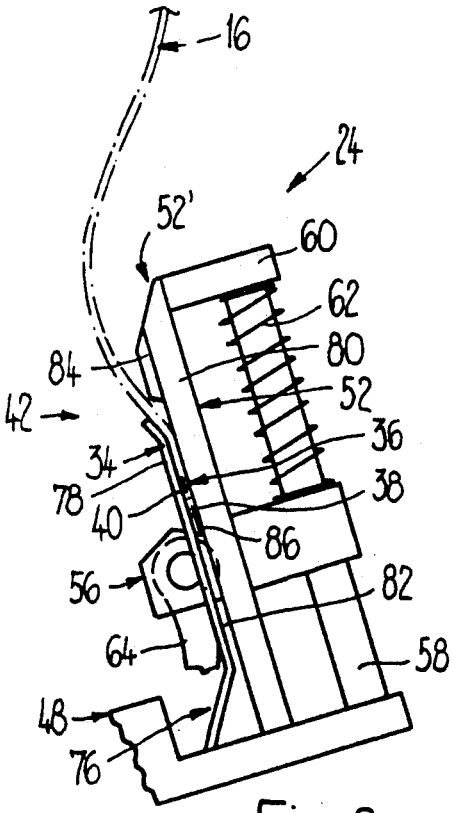
FIG. 8 schematically shows the gripper of the opening device at a third moment of time during the product opening operation.

Having now had the benefit of the foregoing description of the opening device 24 for opening off-center folded printed products 16 as contemplated by the present invention, the mode of operation of the opening device 24 and the product opening process are hereinafter described in conjunction with FIG. 3 and FIGS. 6 through 9 and are as follows:

In FIG. 3 and FIGS. 6 through 9, the folded printed products 16 retained by the individually controllable clamps or grippers 14 and transported in the predetermined direction of conveyance F are indicated in dot-dash lines. The printed products 16 are thereby fixedly retained at their off-center fold 32 (cf. FIG. 1), so that the printed products 16 cannot yield or give way at the product-fold side or edge when being ejected from the slide gaps 82. The endless chains 44 and 44' driven in the predetermined direction of revolving motion V convey, in the region of the lower run thereof, the grippers or gripper units 42 towards the two guide or sprocket wheels 46. The respective guide or control rolls 72' thereby contact the cam-like control member 94 which is configured such that each movable gripper jaw 76 is pivoted into the open position 76' thereof, when the respective grippers or gripper units 42 enter the region of the two guide or sprocket wheels 46. The conveyor device 10 and the opening device 24 are synchronized in such a manner that now, i.e. towards the end of rotating motion about the guide or sprocket wheels 46, an open gripper or gripper unit 42 encompasses from below a respective printed product 16 conveyed in freely suspended or hanging manner as depicted in FIG. 3 at the first gripper or gripper unit 42, when looking in the predetermined direction of conveyance F. During further rotation of the endless chains 44 and 44', the guide or control roll 72' of the respective gripper or gripper unit 42 moves away from the cam-like control member 94, so that the movable gripper jaw 76 can pivot into its closed position due to the restoring spring force of the tension spring 92. Approximately at the same time or shortly prior thereto, as depicted in FIG. 6, or then shortly subsequent thereto, the respective gripper or gripper unit 42 is pivoted by means of the guide rods or links 96 in such a manner that the free end region 52' of the stationary or non-mobile gripper jaw 52 effects relative to the chains 44 and 44' a forward movement in the predetermined direction of conveyance F. As a result, the printed products 16 gripped or engaged by the grippers or gripper units 42 are pre-bent or pre-curved in such a manner that, with respect to the bowing-out or doming of the respective printed product 16, the first product portion 36 with the marginal lap 38 is inlying relative to the second product portion 40, as particularly evident by referring to FIG. 7. The printed products 16 are thus bent out of the plane defined by the freely hanging position thereof, so that the lower open-edge region 34 of each printed product 16 retained within the slide gap 82 of the respective gripper or gripper unit 42 is directed inclinedly downwards to the rear.

The grippers or gripper units 42 located in the region of the upper run are further conveyed synchronously with the individually controllable clamps or grippers 14 of the conveyor device 10, whereby the guide or control rolls 72 now come into contact with and travel upon the cam-type control element 74 such that in each case the pusher member 56 is pushed towards the lower open-edge region 34 of the first product portion 36 (cf. FIG. 8), thereby engaging the marginal lap 38 by means of the groove 86 and pushing the first product portion 36 in the direction towards the open end of the slide gaps 82. Since the printed products 16 have been pre-bent such that the first product portion 36 is the inlying product portion, the second product portion 40 is forcibly entrained during the product ejection operation, because the second product portion 40 bears against the first product portion 36. Since the respective printed products 16 are retained or held by the individually controllable clamps or grippers 14, the printed products 16 are bent to a greater extent by the pushing action within the slide gaps 82. As soon as the outlying second product portion 40 leaves the slide gaps 82, the second product portion 40 being shorter than the first product portion 36, the inherent stability or elasticity of the printed product 14 ensures in each case that this second product portion 40 moves away or separates itself from the first product portion 36 still retained with its marginal lap 38 in the slide gaps 82.

Figure 9:
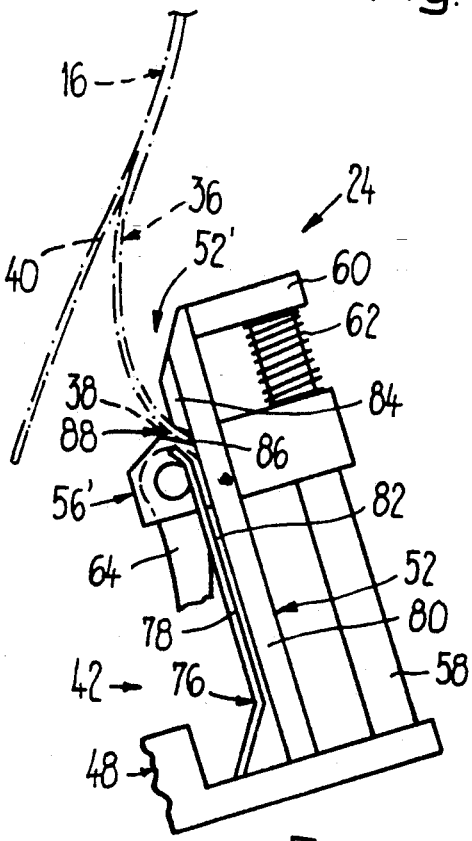
FIG. 9 schematically shows the gripper of the opening device at a fourth moment of time during the product opening operation.

In the course of further travel of the pusher member 56 up to the ejection position 56' depicted in FIG. 9, the marginal lap 38 of the first product portion 36 is also pushed out of the slide gaps 82. However, this marginal lap 38 is now firmly clamped in the clamping nip or gap 88 between the bead-like nose 84 and the pusher member 56. The inclination or slant of this clamping nip or gap 88 further augments the bending or bowing-out of the first product portion 36 and prolongs the time for driving in the respective keep-open member 28 between the product portions 36 and 40 partially separated from each other, i.e. at least in the region of the corner 16". In order to ensure for varying product thicknesses the clamping or retention of the marginal lap 38 of the first product portion 36 in the clamping nip or gap 88, the cam-type control element 74 is resiliently suspended by means of a pressure spring or equivalent structure indicated in FIG. 3 and conveniently designated by reference numeral 74'. As soon as the guide or control roll 72 now moves off of the cam-type control element 74 in the end region of the upper run of the opening device 24, the respective pusher member 56 is retracted by the related compression or pressure spring 62 into the rest or inoperative position and, accordingly, the marginal lap 38 of the first product portion 36 is released.

Figure 10:
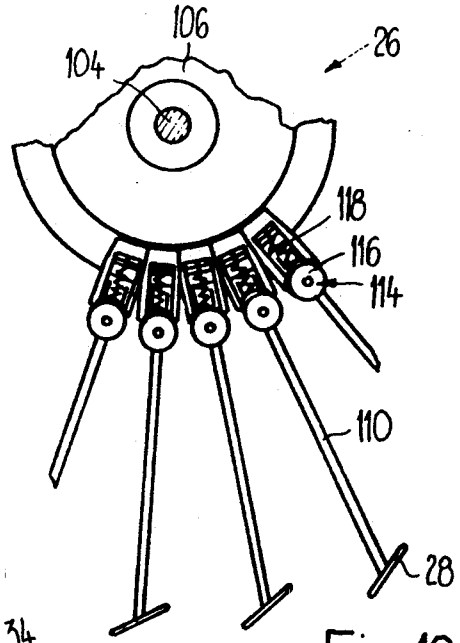
FIG. 10 schematically shows a part or portion of a maintaining-open device.

The maintaining-open device 26 (cf. FIGS. 1, 2 and 10) comprises a shaft 104 rotatably mounted at a frame or stand 102 of the conveyor device 10, at which frame or stand 102 the opening device 24 is also supported. A wheel hub 106 and a chain sprocket wheel 108 are keyed upon the freely rotatable shaft 104, whereby bars or rods 110 arranged in spoke-like manner at the wheel hub 106 are pivotably mounted at respective pins 112 extending in the tangential direction relative to the hub 106. Each bar or rod 110 supports at its free end one of the keep-open members 28 advantageously formed as a tapered scoop or a pointed triangular plate, whereby the point or vertex of the latter is directed toward the lateral edge 16' of the respective printed product 16. An arm 114 projects from each bar or rod 110 at the respective pin 112, this arm 114 supporting at its free end a rotatably mounted roll 116. Between the arm 114 and the wheel hub 106 there is provided a tension spring 118 for the purpose of retaining the respective bar or rod 110 with the related keep-open member 28 in the position indicated by dot-dash lines in FIG. 2, in which position the bar or rod 110 and particularly the related keep-open member 28 are located externally of the region of the respective printed product 16. Below the freely rotatable shaft 104 there is provided a banana-shaped control cam or curve 120, upon which in each case the freely rotatable rolls 116 travel during rotation of the hub 106 keyed upon the shaft 104. As a result, each bar or rod 110 is pivoted into a plane which extends substantially at right angles to the shaft 104, whereby the related keep-open member 28 plunges into the respective printed product 16 opened by the opening device 24 in the region of the lateral edge 16', as seen by referring to FIG. 2 and which in FIG. 3 is the case at the last gripper or gripper unit 42 located in the upper run, as viewed in the predetermined direction of conveyance F.

The spacing or distance between the free ends of the bars or rods 110 is selected such that it corresponds approximately with the essentially uniform spacing between the clamps or grippers 14 of the conveyor device 10, and the circumferential speed is determined such that it corresponds approximately with the conveying speed of the conveyor device 10. As particularly well seen by referring to FIG. 10, each keep-open member 28 is inclined—with respect to a plane perpendicular to the respective bar or rod 110—about an axis extending substantially parallel to the shaft 104, so that the keep-open members 28 are substantially parallel to the predetermined direction of conveyance F only in a region located downstream of the shaft 104, as viewed in the predetermined direction of conveyance F. By virtue of such tilting motion relative to the partially opened printed products 16, the two product portions 36 and 40 of each printed product 16 are further separated or lifted off from one another in the region of the lateral edge 16', whereby this beneficial effect is further augmented inasmuch as the keep-open members 28 rotating with the shaft 104 move in the direction towards the clamps or grippers 14 traveling in the straight lower conveying-active run 10' of the conveyor device 10. A saddle-shaped support 20 of the collecting device 22 now moves from below into the respective printed product 16 thus opened and kept open in the region of the downwardly hanging corner 16" and of the lateral edge 16'. The circumferential speed of the only very schematically depicted collecting device 23 corresponds approximately with the conveying speed of the conveyor device 10, i.e. the speed at which the printed products 16 are conveyed. Now before the keep-open member 28 arrives at the region of the product fold 32 of the respective kept-open folded printed product 16, the related roll 116 moves off of the banana-shaped control cam or curve 120. As a result, the respective bar or rod 110 with its keep-open member 28 is pivoted out of or retracted from the lateral edge 16' of the respective printed product 16.

The conveyor device 10 as depicted in FIGS. 1 and 2 is generally known and the construction as well as the mode of operation of the individually controllable clamps or grippers 14 have been described in detail, for instance, in Swiss Patent No. 644,816, published Aug. 31, 1984 and in the essentially cognate U.S. Pat. No. 4,381,056, granted Apr. 26, 1983 and assigned to the assignee of the instant application.

The endless traction element 12, for instance a conveyor chain, is guided within a C-shaped channel or track 122 by means of wheels 124 and trained at the end of the conveying-active run, i.e. downstream of the take-over or transfer or delivery region 18, around a deflection or guide wheel 126. The C-shaped channel or track 122 possesses at its outer side a longitudinal or lengthwise extending slot 122'. The traction element 12 comprises extension arms or brackets 128 which are arranged at a relatively uniform spacing from one another and piercingly extend through the longitudinal or lengthwise slot 122', the individually controllable clamps or grippers 14 being respectively arranged at these extension arms or brackets 128. At each extension arm or bracket 128 there is secured a U-shaped stirrup 130, at which a shaft or axle 132 is pivotably mounted. At this shaft 132 there is secured at one end thereof an elbowed actuating lever 134 which carries at its free end an actuating roll 134' coacting with a closing control cam or curve 136. In the mid-region of the shaft 132, a first clamping jaw 138 structured in leaf spring-like manner is seated at the shaft 132 such as to be non-rotatable relative thereto. This first clamping jaw 138 cooperates with a second clamping jaw 140 which is freely rotatably mounted at the shaft 132. This second clamping jaw 140 supports eccentrically to the shaft 132 a jaw roll or roller 144 which coacts with a control cam or curve 142. Furthermore, a latching or locking lever 146 is mounted at the second clamping jaw 140, this lever 146 coacting with a not particularly illustrated lock-in nose provided at the elbowed actuating lever 134. In the closed position, the latching or locking lever 146 is engaged at the nose of the actuating lever 134, so that under the pre-bias of the first clamping jaw 138 the two clamping jaws 138 and 140 firmly clamp the respective printed product 16 and are locked against each other. At the end of the transfer or delivery region 18, the latching or locking lever 146 contacts and travels upon an opening control cam or curve 148 which effects the release of the lever 146 from the nose located at the elbowed actuating lever 134. In this manner, the respective printed product 16 falls in a straddling fashion or configuration upon the corresponding saddle-shaped support 20 under the action of its own weight. A yielding or deflection of the clamps or grippers 14 is thereby appropriately prevented by the respective jaw rolls or rollers 144 traveling upon the control cam or curve 142. In order that the printed products 16 can be fed or conveyed to the opening device 24 in a substantially vertical hanging position, the corresponding position of the individually controllable clamps or grippers 14 is determined by the closing control cam or curve 136 and the control cam or curve 142, these control cams or curves retaining the clamps or grippers 14 in the corresponding position by means of the actuating roll or roller 134' and the jaw roll or roller 144, respectively. Such position of the clamps or grippers 14 is maintained in the region of the opening device 24, in the region of the maintaining-open device 26 and in the transfer or delivery region 18.

For the purpose of driving the opening device 24 and the maintaining-open device 26, the conveying motion of the endless traction element 12 is taken over from the deflection or guide wheel 126 (cf. FIG. 1) and transferred by means of a first chain drive 150 indicated in dot-dash lines to a drive shaft 152. Two further sprockets or sprocket wheels 154 and 154' likewise schematically depicted in dot-dash lines are keyed upon the drive shaft 152. The sprocket wheel 154 is operatively connected by means of a schematically indicated chain 156 with the chain sprocket wheel 108 of the maintaining-open device 26. The other sprocket wheel 154' at the drive shaft 152 drives, by means of a schematically indicated chain 156' and two phantom line illustrated chain drives 158 and 158' connected in series as well as by means of a not particularly illustrated but conventional reverse gear for reversing the sense of rotation, the rotational shaft or axle 100 of the opening device 24, this shaft 100 supporting the guide or sprocket wheels 46' keyed thereupon. The opening device 24 as well as the maintaining-open device 26 thus forcibly always run synchronously with the conveyor device 10.

Figure 11:
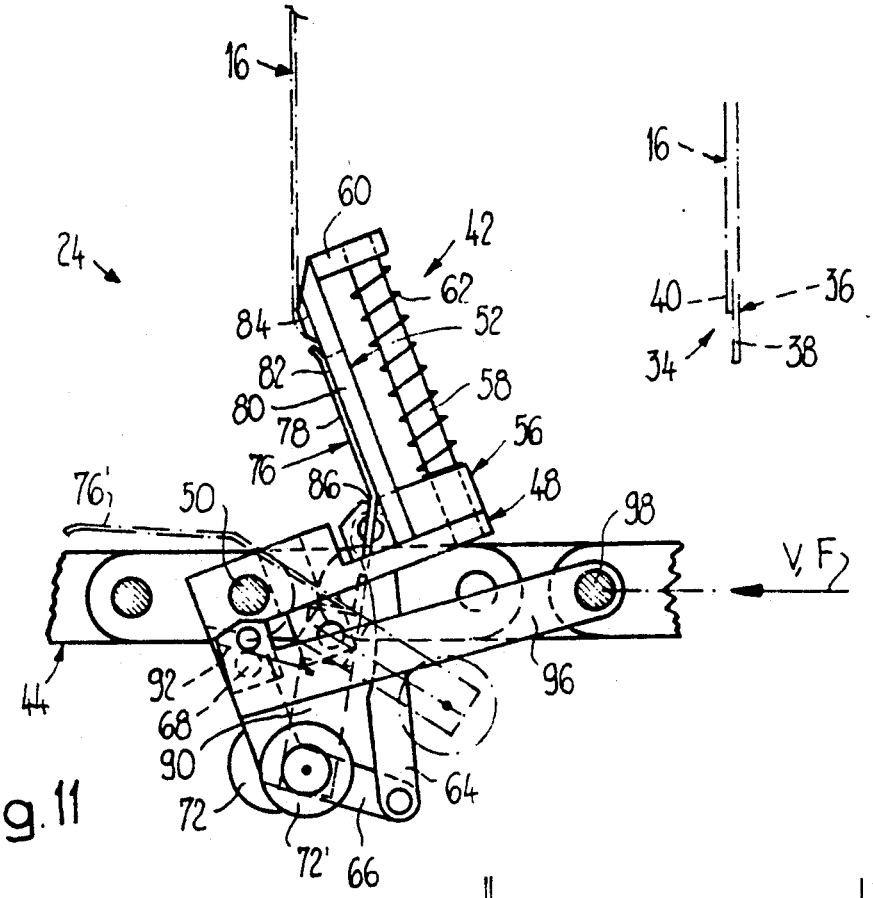
FIG. 11 schematically depicts in the same illustration as FIG. 4 an individual gripper of the opening device for opening printed products which have been folded off-center and in which in each case, when looking in the direction of conveyance, a longer first product portion possessing a marginal lap, which protrudes beyond the other or shorter second product portion, is trailing.

In FIG. 11 there is illustrated a gripper or gripper unit 42 as already depicted in FIG. 4 and hereinabove described in detail. The direction of revolving motion V, which corresponds with the direction of conveyance F, has been indicated by an arrow. As indicated in FIG. 11 by means of a separately drawn lower open-edge region 34 of a printed product 16 depicted in dot-dash lines, the first product portion 36, comprising the marginal lap 38, of the printed product 16 retained by a not particularly illustrated gripper or gripper unit is trailing with respect to the second product portion 40, as viewed in the direction of revolving motion V or in the direction of conveyance F. By virtue of the swinging or pivoting of the gripper jaws 52 and 76 to the fore, when looking in the direction of conveyance F, the gripped or engaged printed product 16 is pre-bent or pre-curved, so that with respect to such bending or curvature the first product portion 36 is inlying and the second product portion 40 is outlying.

Figure 12:
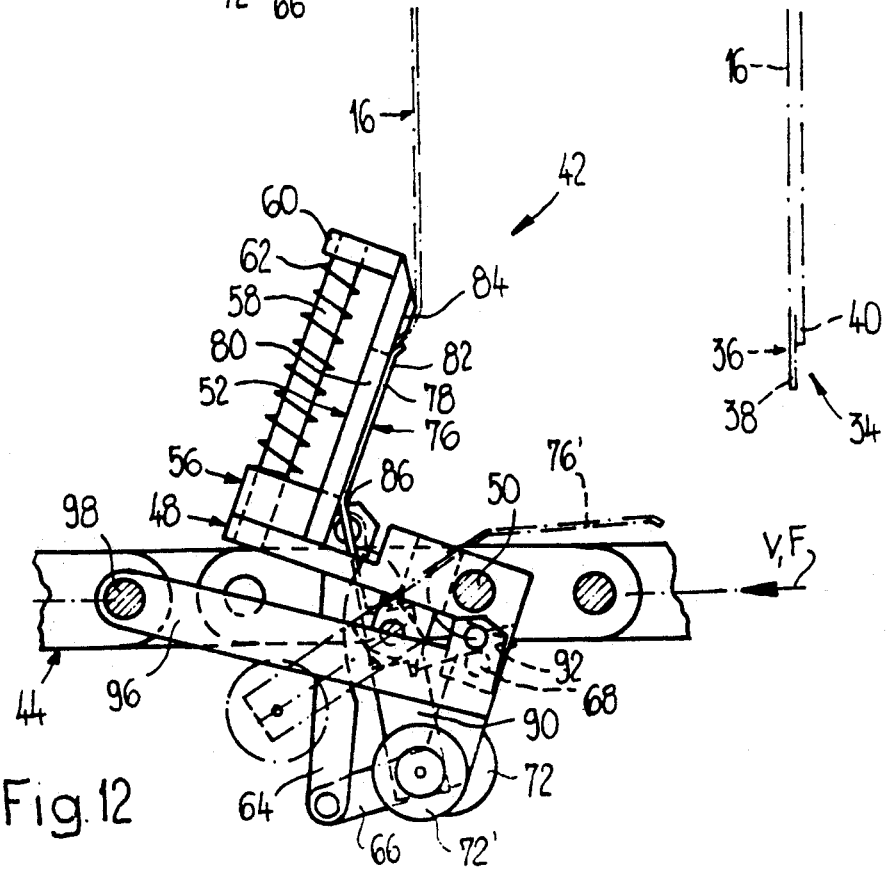
FIG. 12 schematically depicts in the same illustration as FIG. 4 an individual gripper of the opening device for opening printed products which have been folded off-center and in which in each case, when looking in the direction of conveyance, the longer first product portion possessing the marginal lap, which protrudes beyond the shorter second product portion, is leading.

In FIG. 12 there is illustrated a gripper or gripper unit 42 which, as far as the construction and the mode of operation are concerned, corresponds with the gripper or gripper unit 42 depicted in FIG. 11. However, this gripper or gripper unit 42 is, with respect to the direction of conveyance F and the direction of revolving motion V, reversedly arranged at the endless chains 44 and 44'. As a result, the slide gaps 82 formed by the gripper jaws 52 and 76 are pivoted to the rear. The arrangement of the gripper or gripper unit 42 depicted in FIG. 12 is suitable for opening printed products 16 in which in each case the first product portion 36 with the marginal lap 38 is leading with respect to the second product portion 40, as indicated in a further separately drawn lower open-edge region 34 of a printed product 16 likewise depicted in dot-dash lines. In this case there is also achieved a respective pre-bending of each printed product 16 by the swinging or pivoting of the grippers or gripper units 42 to the rear, as viewed in the direction of conveyance F and the direction of revolving motion V.

The swinging or pivoting of the grippers 42 out of the plane defined by the unaffected or uninfluenced printed products 16 is not forcibly necessary for pre-bending the printed products 16, provided that the bead-like nose 84 is correspondingly structured to achieve an adequate pre-bending, in order to ensure further bending in the same direction during the ejection of the printed products 16 from the slide gaps 82. If need be, it is also possible to dispense with the bead-like nose 84 when pre-bending of the printed products 16 is ensured in another manner, for instance, by pivoting the slide gaps 82.

It is also conceivable to provide the grippers or gripper units for opening the printed products in a so-called product-insert device such as a cell wheel provided with radially extending and outwardly open compartments which serve for receiving folded printed products to be opened. The grippers or gripper units 42 constructed according to the present invention can thereby replace, for example, the opening device disclosed in the aforementioned Swiss Patent No. 644,814 and the corresponding U.S. Pat. No. 4,398,710.

It is also possible to structure the grippers or gripper units in such a manner that both gripper jaws are movable or, as the case may be, the movable gripper jaw is displaceable transversely to the plane of the slide gap or gaps in the direction towards the stationary gripping jaw and away from the latter.

It is also readily conceivable to structure the pusher member to perform a pivoting or swinging motion in lieu of the translatory displacement.

The opening device formed in accordance with the present invention is suitable for opening individual off-center printed sheets as well as for opening multi-sheet printed products which have been folded off-center or asymmetrically.

While there are shown and described present preferred embodiments of the invention, it is to be distinctly understood that the invention is not limited thereto, but may be otherwise variously embodied and practiced within the scope of the following claims.

Accordingly, What I claim is:

1. A method of opening flexible, off-center folded products, such as printed products, each having an off-center fold, a first product portion, a second product portion and in an open-edge region, located opposite the off-center fold, a marginal lap at the first product portion, the marginal lap protruding beyond the second product portion, comprising the steps of:

holding the folded products at the off-center fold thereof;

gripping in each case at least the marginal lap of the folded products by means of gripper jaws of a gripper of an opening device, the gripper jaws being movable relative to one another;

said step of gripping in each case at least the marginal lap entailing the step of gripping in each case both product portions at the open-edge region thereof by means of the gripper and the step of conjointly pre-bending in each case both product portions;

the gripper jaws in the closed position thereof forming a slide gap for the product portions;

moving the open-edge region within the slide gap by pushing the marginal lap of the first product portion towards the related off-center fold;

said step of moving the open-edge region entailing the step of ejecting at least the second product portion from the slide gap; and the second product portion moving apart from the first product portion as a result of the bowing-out of the first product portion.

2. The method as defined in claim 1, further including the step of:

following the ejection of the second product portion from the slide gap pushing the marginal lap of the first product portion out of the slide gap.

3. The method as defined in claim 2, wherein:

said step of pushing the marginal lap out of the slide gap entails using a pusher member acting upon the edge of the marginal lap and, following the ejection of the marginal lap from the slide gap, clamping the marginal lap between the pusher member and a bead-like nose of the gripper.

4. The method as defined in claim 3, wherein:

said step of clamping the marginal lap entails bending the first product portion away from the second product portion.

5. The method as defined in claim 1, wherein:

said step of conjointly pre-bending both product portions of a respective folded product engaged by a gripper entails pivoting the respective slide gap about an axis extending substantially parallel to the off-center fold; and said step of pushing the marginal lap towards the related off-center fold and said step of ejecting at least the second product portion from the slide gap entail further bending of the respective folded product.

6. The method as defined in claim 1, further including the step of:

inserting a keep-open member into an opening formed between the separated product portions of the respective folded product for the purpose of maintaining open the folded product opened by the opening device.

7. The method as defined in claim 1, further including the steps of:

conveying in a direction of conveyance the folded products in a suspension position;

said step of holding the folded products at the off-center fold thereof entailing holding the folded products by grippers of a conveyor device and positioning the folded products with the off-center fold thereof extending in a direction substantially transverse to the direction of conveyance;

opening the folded products by means of the opening device; and depositing the opened folded products in a straddling manner upon respective saddle-shaped supports of s collecting device.

8. An apparatus for opening flexible products which have been folded off-center, such as printed products, each having an off-center fold, a first product portion, a second product portion and in an open-edge region, located opposite to the off-center fold, a marginal lap at the first product portion, this marginal lap protruding beyond the second product portion, comprising:

holding means for holding each folded product at the off-center fold thereof;

an opening device having at least one gripper;

said at least one gripper comprising gripper jaws movable in relation to one another for gripping at least the marginal lap of a respective folded product;

bending means serving to bend at least the first product portion engaged by the at least one gripper in order to at least partially lift off the first product portion and the second product portion from one another;

said at least one gripper serving to grip both product portions at the open-edge region and said gripper jaws assuming thereby a closed position;

said gripper jaws in said closed position forming a slide gap for both product portions;

said bending means being structured for conjointly pre-bending both product portions engaged by said at least one gripper;

said slide gap having an open end facing said holding means and extending in a lengthwise direction; and said at least one gripper being provided with a pusher member movable in said lengthwise direction of said slide gap for acting upon the first product portion at the marginal lap thereof in order to push the open-edge region towards said open end of said slide gap until at least the second product portion leaves said slide gap.

9. The apparatus as defined in claim 8, wherein:

said slide gap is configured to be approximately of the same length as the open-edge region to be gripped; and said gripper jaws in said closed position extend substantially parallel to one another.

10. The apparatus as defined in claim 8, wherein:

said slide gap is configured to be longer than the the open-edge region to be engaged; and said gripper jaws in said closed position extend substantially parallel to one another.

11. The apparatus as defined in claim 8, wherein:

one of said gripper jaws comes to bear upon the first product portion;

an other one of said gripper jaws possesses a free end;

said one gripper jaw protruding beyond said free end of said other one gripper jaw and defining thereby a protruding region; and said protruding region comprising a protuberant structure which overlaps said slide gap at a distance.

12. The apparatus as defined in claim 11, wherein:

said protuberant structure constitutes a bead-like nose.

13. The apparatus as defined in claim 11, wherein:

said pusher member is displaceably mounted at one of said gripper jaws;

said slide gap possesses an inner end; and drive means are provided for moving said pusher member from a rest position located at said inner end of said slide gap in the direction towards an ejection position located at said open end of said slide gap and from said ejection position back to said rest position.

14. The apparatus as defined in claim 13, wherein:

said pusher member in said ejection position forms together with said protuberant structure a clamping nip for the marginal lap of the first product portion.

15. The apparatus as defined in claim 14, wherein:

said clamping nip defines with said slide gap an obtuse angle.

16. The apparatus as defined in claim 11, wherein:

said at least one gripper comprises a base body;

said one gripper jaw which bears upon the first product portion being stationarily arranged at said base body and constituting a stationary gripper jaw;

said other one gripper jaw being pivotably mounted at said base body and constituting a movable gripper jaw; and said pusher member being displaceably mounted at said stationary gripper jaw.

17. The apparatus as defined in claim 11, wherein:

said at least one gripper comprises a base body;

said one gripper jaw which bears upon the first product portion being stationarily arranged at said base body and constituting a stationary gripper jaw;

said other one gripper jaw being displaceably arranged at said base body and constituting a movable gripper jaw; and said pusher member being displaceably mounted at said stationary gripper jaw.

18. The apparatus as defined in claim 16, wherein:

said at least one gripper is pivotably mounted for pre-bending the respective folded products.

19. The apparatus as defined in claim 16, wherein:

said base body is pivotably mounted in order to pre-bend the respective folded product.

20. The apparatus as defined in claim 16, wherein:

said holding means comprise a conveyor device defining a predetermined direction of conveyance;

said conveyor device comprising individually controllable clamps revolvingly driven in said predetermined direction of conveyance and successively arranged in a mutual spaced relationship;

said individually controllable clamps serving to hold and convey the folded products at the respective off-center folds thereof;

said opening device comprises at least two guide wheels and a revolvingly driven traction element trained about said at least two guide wheels;

said at least one gripper constituting a plurality of grippers arranged at said traction element and spaced essentially at the same distance as said individually controllable clamps of said conveyor device; and each gripper being operable to act upon a respective folded product to be opened.

21. The apparatus as defined in claim 20, wherein:

the folded products held by said individually controllable clamps at the off-center fold thereof are conveyed in a suspension position and with the off-center folds extending in a direction substantially transverse relative to said predetermined direction of conveyance.

22. The apparatus as defined in claim 20, wherein:

each said base body is pivotably mounted at said traction element;

said opening device possesses a start region as viewed in said predetermined direction of conveyance;

one of said at least two guide wheels for said traction element being arranged at said start region of said opening device;

an imaginary plane extends through each said gripper and the respective individually controllable clamp;

a guide link is provided for each said base body; and said guide link having oppositely situated ends and pivotably acting with one end thereof at said base body and being connected at the other end thereof with said traction element in order that each said gripper, upon being trained off of said guide wheel arranged at said start region of said opening device, is pivoted in such a manner that said slide gap stands transversely relative to said imaginary plane for the purpose of pre-bending the respective folded product.

23. The apparatus as defined in claim 22, wherein:

said movable gripper jaw is operable between an open position and a closed position and is pre-biased in the closing direction;

a control member for opening said movable gripper jaw is provided in the region of said guide wheel arranged at said start region of said opening device;

said opening device possesses an opening-active run; and said drive means for moving said pusher member comprising in the region of said opening-active run a control element for said pusher member.

24. The apparatus as defined in claim 23, wherein:

said control member for opening said movable gripper jaw is a cam-like control member; and said control element for moving said pusher member is a cam-like control element.

25. The apparatus as defined in claim 20, further including:

a product processing station arranged downstream of said opening device as viewed in said predetermined direction of conveyance;

said processing station being provided with a plurality of revolvingly driven saddle-shaped supports; and said saddle-shaped supports serving to receive the opened folded products in a straddling manner.

26. The apparatus as defined in claim 20, further including:

a maintaining-open device arranged downstream of said opening device as viewed in said predetermined direction of conveyance;

said maintaining-open device being provided with keep-open members; and said keep-open members being insertable in each case between the first product portion and the second product portion lifted off of one another and being co-movable substantially in said predetermined direction of conveyance.

27. The apparatus as defined in claim 26, wherein:

said maintaining-open device further comprises a freely rotatable shaft;

said shaft being provided with bars arranged in spoke-like manner thereat;

each said bar having oppositely situated ends and being supported at one end thereof at said shaft and serving for mounting an associated one of said keep-open members at the other end thereof;

respective pivot axles are provided for said bars arranged in spoke-like manner;

said pivot axles extending in the tangential direction with respect to said freely rotatable shaft;

a control device is provided for controlling the movement of said bars: and said bars being respectively rotatably mounted at said pivot axles and pivotable by means of said control device in such a manner that said keep-open members engage and disengage the respective opened folded products.

28. The apparatus as defined in claim 27, wherein:

said keep-open members are shaped to be substantially triangular.

* * * * *